United States Patent [19]

Smejda

[11] 3,958,533

[45] May 25, 1976

[54] PINSTRIPE APPLICATION SYSTEMS

[76] Inventor: Richard K. Smejda, 192 Edmund Ave., Paterson, N.J. 07502

[22] Filed: Aug. 27, 1974

[21] Appl. No.: 501,076

[52] U.S. Cl. ..... 118/411; 68/200

[51] Int. Cl.[2] ..... B05C 5/02

[58] Field of Search ..... 118/411, 412, 415; 68/200; 8/149

[56] References Cited

UNITED STATES PATENTS

| | | | |
|---|---|---|---|
| 2,065,576 | 12/1936 | George | 118/412 X |
| 2,494,378 | 1/1950 | Dexter | 118/415 X |
| 2,774,326 | 12/1956 | Nelson | 118/410 X |
| 2,833,242 | 5/1958 | Neidich et al. | 118/411 X |
| 3,319,603 | 5/1967 | Hesselmann | 118/410 |

*Primary Examiner*—John P. McIntosh

[57] ABSTRACT

The pinstripe application system according to this invention provides apparatus and devices for the application of a plurality of mostly narrow stripes created by diversified liquids emanating from a large number of feeder chambers and patterned by one or more exchangeable pin strips which are perforated in accordance with the desired location of a multitude of distinct, or joining, or overlapping stripes produced by moving the substrate or carrier to be decorated at a direction of generally 90° to the lateral extension of the applicator and having means to adjust pressure, angle, and flow characteristics in a manner to simplify and enhance this method of application, as well as locations and sequences for combination with one or more different type color application devices.

9 Claims, 6 Drawing Figures

PINSTRIPE APPLICATION SYSTEMS

This invention relates to the supply, feeding and staging and in particular instances overlapping of narrow fluid bands in variable individual and in variable total width comprising an infinite number of combinations and variations and means to guide these generally narrow fluid bands in a controlled and reliable manner to an application plane where they are adhering to and removed by one continuously or intermittently moving surface representing a substrate or a carrier.

One object of this invention is to provide means and apparatus for multiple fluid feeding to be applied to a moving surface either stretched between a number of rollers or carried with the assistance of an elastic blanket, or directly to a transfer medium with means or patterns for additional modification of the fluid deposits.

Another object of this improvement provides means for the efficient and inexpensive patterning of a multitude of generally narrow fluid bands in a manner which avoids boundary interference and friction from influencing the ready and unimpaired feeding of the multiple liquid streams to the application plane.

It is a special object of this invention to permit overlap of two or more liquids within the same design location within the application plane producing a continuous overlay of several narrow fluid bands according to the predetermined design on the surface being moved across the application plane of the pinstripe system.

Another object is the formation of staging chambers with dividers such as ribs and bridges serving also as sealing support of the pinstrip during operation and adjustable means for perfectly even stretching of the laterally extending pinstrips across the supporting elements.

It is a further object of this invention to assure the smooth passage of the substrate in front of the pin-strip by recessing part of the small liquid orifices in a way to prevent the passing area of the substrate from getting caught, snagged or abraded in any conceivable way.

Other objects of the invention will in part be obvious and will in part appear hereinafter. The invention accordingly comprises the process involving the several steps and the relation and order of one or more of such steps with respect to each of the others and the apparatus possessing the construction, combination of elements and arrangements of parts which are exemplified in the following detailed disclosure, and the scope of the invention which will be indicated in the claims.

For a fuller understanding of the nature and objects of this invention, reference should be had to the following drawings illustrating simple forms of the pinstripe application system. It must be understood that the infinite variety of possible combinations under these improvements cannot be displayed exhaustively and that the drawings are merely illustrations of one single modus of patterning which anyone acquainted with the art may vary without leaving the scope of this invention. With these and other objects in view, which will become apparent in the following detailed description, the present invention will be clearly understood in connection with the accompanying drawings in which:

Figure 5A:
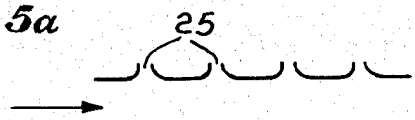
Figure 5B:
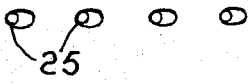

FIGS. 5*a* and 5*b* are schematic side and plan views respectively, to show one example of recessed orifices, — the arrow illustrates the direction and position of the substrate in relation to the orifices.

Figure 1:
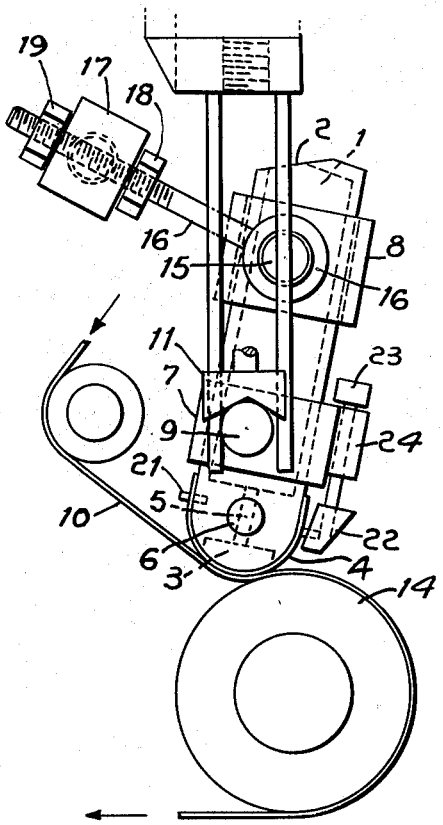
FIG. 1 is a partial side elevation of the pinstriping arrangement in combination with a diagrammatic depiction of the passing substrate and the supporting roller.

The principal body of the pin stripe applicator is composed of numerous feeder chambers 1 to supply diversified liquids which are physically separated from each other feeder and each is filled or replenished through one or more supply openings 2 with a capability of one or more liquid components in each feeder 1. Openings 2 are conveniently located at an area designed as the upper side at any particular modus of application. This upper side will be structurally modified according to varying demands on actions and locations of the pin-stripe-applicator. The position shown in FIGS. 1 and 2 is almost vertical but the pin-stripe-applicator functions equally effective at any other angle going even beyond the horizontal axis as long as enough fluid pressure is present to ensure the constant refurbishing of liquid into the staging area 3.

Figure 3:
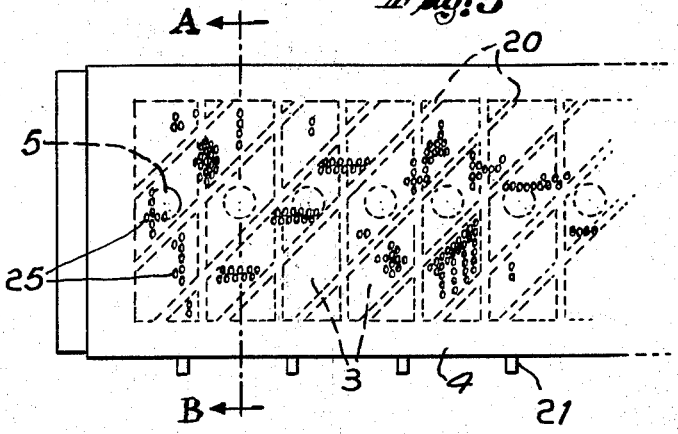
FIG. 3 is a diagrammatic view of the diagonal cross chanelling in the application plane with a pattern strip, — or pin strip, — in place and example of patterning orifices.

The feeder chamber 1 is connected to the staging area 3 with the open bore 5 which is optionally pierced by the valve rod 6 penetrating all bores 5 simultaneously and having a multitude of valve orifices at distances equal to the bores 5 with the ability to partially open, fully open, or close all bore-5-connections to the staging area 3 at the same instance. For activating purposes a lever is attached to one or both extremities of the valve rod and a turn of 90° accomplishes closing or opening. The diameter of bore 5 is small enough to permit the conversion from the wider cross-section of the feeder 1 to the narrower rhomboidal staging area 3. The area 3 is capable to carry an increasing number of overlapping positions the more the angle deviates from the vertical borderline to the near horizontal. FIG. 3 illustrates one 45° position of the diagonal ribs 20.

The pin-stripe-applicator generally comprises the feeder chambers 1, the staging area 3 and the pin strip 4 and is held in operating position and guided by the two collars 7 and 8. Collar 7 has a shaft extension 9 on both lateral extremities but shown only as section of the left half. The shaft extension 9 is used to receive and apply adjustable pressure of the entire pin-stripe-applicator against the substrate 10 or a carrier or both in conjunction. The direction of movement is either in the sense of the arrow or 180° in reverse.

Figure 2:
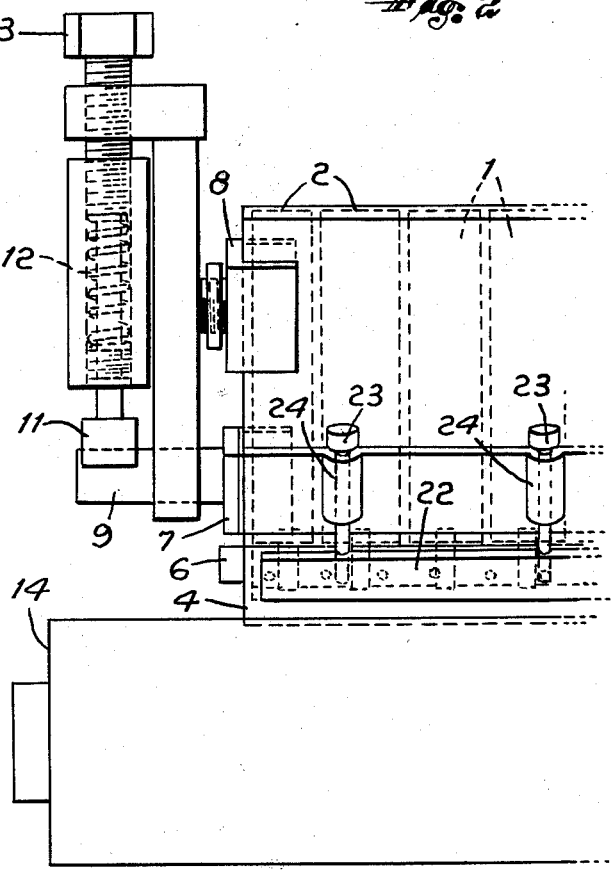
FIG. 2 is a partial front elevation of the left section of the pinstripe arrangement showing the pressure adjustment omitted for clarity considerations in FIG. 1.
Figure 4:
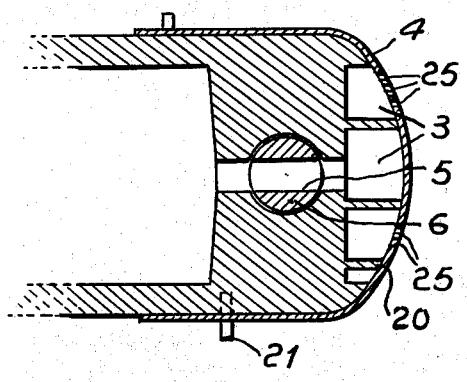
FIG. 4 is a diagrammatic cross section along the line A-B to illustrate the connection between main supply, bore connection and staging area.

FIG. 2 shows the pressure arrangement with the collar of the plunger 11 being pushed forward by the coil spring 12 which is adjustably depressed by the screw 13 and acts on the shaft 9 being attached to the collar 7 holding the pin-stripe-applicator. This arrangement of two plungers 11 at both lateral extremities will hold the applicator against the substrate with just enough adjusted pressure to form a continuous hollow depression to fit and pass around the curved pin-strip 4. It is obvious that this pressure adjustment may be carried out by any other pneumatic, hydraulic, or mechanical set-up within the meaning of this improvement.

To regulate kinetic energy of the fluid supply and to put the curve of the pin-strip 4 into the desired position in regard to the roller 14 the rod 15 on collar 8 permits an angle adjustment without losing rigidity. The angle is adjusted by pushing the eye bolt 16 forward or pulling it back by means of the two nuts 18 and 19. During this movement the bolt 16 slides in the pivoting cube 17. The two forces acting downward or forward on collar 7 and in angular direction on collar 8 provide all necessary guidance to bring and hold the pin-stripe-applicator in the most favourable production position.

The pin-strip 4 has to be stretched tightly across the diagonal ribs 20 of staging area 3. To this purpose one lateral selvage of pin-strip 4 is perforated at short intervals to be hooked into equidistant pins 21 positioned laterally along one side of the pin-stripe-applicator. The opposite selvage of the pin-strip 4 is equally perforated to engage the fitting pins of bar 22 which is threaded at convenient distances for the insertion of screws 23 turning freely in the bores 24 going through collar 7. Tightening the screws 23 will pull the bar 22 upward and proceed until the equally upward moving pins completed stretching the pin-strip 4 into sealing contact around the diagonal ribs 20 presenting in their totality a curved surface. For more efficient sealing the ribs 20 are optionally covered with resilient sealing surface and/or the pin-strip 4 has a layer of elastic material affixed to it to facilitate sealing at all points of contact.

The pin-strip 4 is perforated for selective passage of decorating or acting liquids along its lateral extension and across a large part of its width with orifices 25 designed to release a narrow flow of liquids of the type emanating from the staging area 3 right behind it. The diminutive cross section of the pin-strip 4,—it is sheet material of one type or another—, obviates boundary interference in laminar flow and makes it feasible to release even liquids with relative high viscosity at considerable speeds of production.

The staging area 3 is oriented at an angle best capable to serve specific pattern notations. The angle of 45° depicted in FIG. 3 is an average mean of the possibilities. The sections A-B in FIG. 3 parallels the direction of passage of any substrate or carrier 10, movement is either up or down. The section A-B traverses four pattern orifices 25 in the second staging area 3, none in the third and one more orifice in the fourth staging area. A substrate passing in the direction of this section A-B, going downward for example, would pick-up in passing four fluid contacts out of the second area 3 and on top of this would take on the last fluid of one orifice from the fourth area 3. To the left of this fall-on of one orifice in the fourth area will be deposited five outlets and four additional ones to the right. Going up diagonally to the right in the fourth area 3 there are 12 more outlet orifices 25 just below center and 12 more orifices higher up to the right. In relation to the passing substrate all three horizontal orifice lines join to produce a liquid deposit of a width corresponding to the total width of all three lines but interspersed and added on by more deposits coming from clusters of orifices 25 in the third and fifth area 3. As your eye proceeds more examples of orifice combinations are illustrated without being able to show fully all the millions of possibilities feasible to a knowledgable designer.

The number of staging areas feasible to overlap through orifices falling into the same vertical line increases with inclining ribs 20 towards the horizontal and decreases as the ribs 20 approach vertical orientation. This rule is applied to to the construction of purposeful types of applicators.

The orifices itself come in different shapes complying to specific exigencies of design and/or substrate, their shapes being either round, oval, diamond-shaped, rectangular or square and other combinations of these basic forms, combinations in shape and/or size. An important feature of these orifices 25 is the recession of the part of each orifice confronting the location of exit of the substrate as it passes. This recession is illustrated in FIGS. 5a and 5b and the direction and location of the substrate is indicated by the arrow. This recession of each orifice 25 assures the efficient and continuous operation during production without clogging of the orifices or abrading of the substrate. This recession makes the operation self-cleaning and assists in releasing the liquid flow into the direction of operation by the lessening of the forces of liquid shearing. It also increases the adhesion/cohesion element of this operation.

The pinstripe application system is able to cover the entire width of the substrate or carrier completely or any selective part thereof. It is also capable to form a highly specialized part in combinations with one or more other printing and application media, such as for example wide striping, roller printing, rotary screen printing, bar printing, spray applications, paddyeing, etc. Some or all of these may be combined to form entirely new types of machines for novel expressions in surface decorating. The pinstripe application system contributes one very valuable specialty in combination with high economy of operation and simplicity of design change.

The foregoing specification serves as an elaboration and explanation of the details of the invention but not a limitation thereof.

I claim:

1. A system for striping materials comprising a plurality of adjacent liquid feeding chambers disposed laterally across a predetermined longitudinal path, said chambers including a plurality of vertical partitions dividing said chambers into like sized independent liquid feeding units, means feeding a sheet of material along said path, a plurality of intermediate angled channels directing liquid from said feeding chambers to said sheet, said channels including a plurality of angled partitions separating said channels and crossing said chambers at an angle with respect to said chamber partitions, means for passing liquid from each liquid feeding chamber to a respective angled channel, and an apertured patterning strip positioned against said angled partitions between said channels and said sheet material and applying liquid from said channels to said sheet, said strip having groups of apertures aligned with respective angled channels to combine liquids along said sheet passing across different channels.

2. The device of claim 1 wherein said angled channels overlap a plurality of said chambers, and said angled partitions have a common fixed acute angle.

3. The device of claim 2 wherein said means for passing liquid include a plurality of bores each connecting a respective feeding chamber to an angled channel.

4. The device of claim 3 including a valve rod extending through said plurality of bores and having a plurality of openings adjustably aligned with said bores for controlling liquid flow through said bores.

5. The device of claim 2 including pivotal mounting means for adjusting the angular position of said chambers with respect to said longitudinal path.

6. The device of claim 2 wherein said channel partitions are curved at the ends adjacent said strip and including adjustable means for holding said strip in tight sealing contact with said ends.

7. The device of claim 2 including means for adjusting the pressure of said channels against said strip.

8. The device of claim 2 wherein the apertures in said strip are curved inwardly away from said sheet and are shaped to direct liquid along said longitudinal path.

9. The device of claim 2 wherein said groups of said apertures have different numbers of apertures and are disposed at different positions across said path to provide selective liquid stripe patterns.

* * * * *